United States Patent [19]

Schiel

[11] 4,028,175

[45] June 7, 1977

[54] CYLINDER MACHINE HAVING POSITIVE PRESSURE CHAMBERS ADJACENT AN OUTER BAND

[75] Inventor: Christian Schiel, Heidenheim-Schnaitheim, Germany

[73] Assignee: J. M. Voith GmbH, Heidenheim, Germany

[22] Filed: June 25, 1976

[21] Appl. No.: 699,949

Related U.S. Application Data

[63] Continuation of Ser. No. 554,425, March 3, 1975, abandoned.

[30] Foreign Application Priority Data

Mar. 13, 1974 Austria ..... 2074/74

[52] U.S. Cl. ..... 162/274; 162/301; 162/305; 162/317; 162/318

[51] Int. Cl.[2] ..... D21F 1/04

[58] Field of Search ..... 162/274, 275, 297, 301, 162/305, 308, 317, 318, 358, 360 R, 199, 203, 205, 208, 210, 212, 214, 352

[56] References Cited

UNITED STATES PATENTS

| | | | |
|---|---|---|---|
| 2,753,766 | 7/1956 | Simpson | 162/297 |
| 3,111,454 | 11/1963 | Tucker et al. | 162/297 |
| 3,352,748 | 11/1967 | Krofta | 162/318 |
| 3,472,733 | 10/1969 | Holt | 162/301 |
| 3,565,757 | 2/1971 | Jordansson | 162/301 |
| R21,201 | 9/1939 | Quiller | 162/297 |

*Primary Examiner*—S. Leon Bashore
*Assistant Examiner*—Richard V. Fisher
*Attorney, Agent, or Firm*—Herbert L. Lerner

[57] ABSTRACT

A paper making machine including a hollow cylinder rotatable in a predetermined direction having a porous surface, a mesh wrapped around the cylinder, an outer band partially surrounding the cylinder and together with the mesh forming an inlet aperture, a nozzle for spraying suspended matter into the aperture, and a housing formed with a plurality of chambers disposed and open on a side facing the cylinder surrounded by the outer band, successive chambers in the direction of operative rotation of the cylinder being increasingly pressurized, the entire inner surface of the cylinder being subjected to a uniform pressure smaller than the pressure exerted on the part thereof surrounded by the outer band.

20 Claims, 8 Drawing Figures

152
151
150'
125
105

122
101'
121
124
123
126
130
128
103
129
150
119
120
121'
118
117
104'
113
116
112
108
104"
101
102
127
153
111
152'
105
104
154
103
105
106
130'
114
105

204"
201'

247
204
209
154
206
204'
208
255
201
227
211
246
210
204
202
240

CYLINDER MACHINE HAVING POSITIVE PRESSURE CHAMBERS ADJACENT AN OUTER BAND

This is a continuation of application Ser. No. 554,425, filed Mar. 3, 1975, now abandoned.

The invention relates to a paper making machine using a cylinder having a porous surface surrounded by a mesh as well as an outer band surrounding the cylinder, which together with the mesh forms an inlet gap or aperture for fibrous suspended matter ejected from a nozzle. In a paper making machine of this type, known from U.S. Pat No. 3,055,719, the outer band is also a mesh, the tension of which causes a pressure between the two meshes, as a result of which water is passed through those meshes. The water pushed through the outer mesh spurts away therefrom simply as a result of the centrifugal forces, while the water pressed through the mesh adjacent to the cylinder is forced thereinto. To further support this inwardly directed forcing action and to discharge the water from the cylinder provision for a suction chamber is made.

At a high number of machine revolutions or at a high machine speed, water does no longer enter the inner chamber of the cylinder as a result of the high centrifugal forces, but is stored in the cylinder coating and spurts off tangentially therefrom at the roll-off points of the meshes, so that no water discharge means are required from the interior of the cylinder. The centrifugal force ensures however, that water discharge from the exterior of the cylinder is more effective than a discharge from its interior. For this reason a vacuum or a suction within the interior of the cylinder is required even at high machine speeds, if a paper sheet or track having different qualities on its respective sides is not to be manufactured. Such a vacuum or suction apparatus is, however, very costly, additionally requires very exact sealing means, and a cylinder coating having a smooth interior. Since the cylinder coating is subjected on its other side to strong forces at high machine velocities, a very costly cylinder construction results.

It is an object of this invention to construct a papermaking machine of the aforesaid type, so that water discharge from the paper sheet or track is controllable without requiring any costly devices to be inserted into the cylinder. This task is solved, according to the invention, by providing external to the cylinder, in a segment thereof surrounded by the outer band, chambers which are open in a direction facing the cylinder, and which are kept under a pressure successively increasing in the direction of rotation of the cylinder, the entire inner surface of the cylinder being exposed to a uniform pressure which is lower than the pressure exerted on the outside thereof.

As a result of the pressure exerted external to the cylinder, the water discharge is directly controlled by the inner mesh. The water discharge from the inner mesh is dependent on the tension prevailing in the outer band. The centrifugal force acts counter, however, to the water discharge force acting towards the interior of the cylinder; the action of the centrifugal force can, however, be cancelled or superseded by the pressure of the external air.

As a result of the use of an outer chamber the interior of the cylinder remains completely free of any insertable devices, resulting in a much simpler, less costly and also more rigid construction of the cylinder. It is particularly possible to reinforce the cylinder interior by braces or the like to make it more rigid and bend-resistant. Additionally a much more quiet operation of the machine is made possible, since no sealing means or suction chambers are required which would produce a considerable noise in the cylinder coating. By supplying a plurality of chambers disposed successively next to each other in the direction of rotation of the cylinder having an increasing pressure in that direction, the pressure exerted on the developing paper sheet or track can be tailored to its rigidity, so that an optimal water discharge is achievable without the paper sheet or track being marked or even damaged.

By the use of external pressure chambers in lieu of inner suction means, it is in particular possible to obtain an improved water discharge compared to suction drums, since the maximum difference of practically 8 meters of water pressure permissible for suction drums can be arbitrarily exceeded by pressure chambers.

In a further advantageous development of the invention the outer band partially surrounding the cylinder is a mesh. This makes it possible to remove water from both sides of the paper sheet or track in a uniform fashion. This water removal or discharge through the outer mesh is completely independent of the pressure prevailing in the chambers and is only dependent on the tension prevailing in the outer mesh. As a result of the pressure existing in the outer chambers the water discharge through the inner mesh within the region of the paper sheet or track can be tailored to the water removal or discharge means acting towards the outside, thus avoiding the formation of unequal qualities or respective sides of the developing paper sheet or track.

Once the paper sheet or track is formed, then further intensive water discharge or removal can be undertaken through increasing the external pressure acting on the last chambers without there being any danger of producing a dual quality of paper on respective sides thereof, the aim being to obtain a product having a very low degree of moisture or being very dry.

It is a further very advantageous development of the invention that the end wall of the last chamber, as seen in the direction of the rotation of the outer band is in contact with a sealing strip on the roll-off point of that outer band, the outer band and the inner mesh surrounding that sealing strip. This sealing strip therefore serves simultaneously for the roll-off of the outer band, the mesh and the paper sheet or track from the cylinder. The radius of curvature of the surface of the sealing strip surrounded by the meshes has, according to the invention, a relatively small radius, i.e. smaller than 10 cm and preferably in the region of 2 to 5 cms.

This permits a positive rerouting of the bands or meshes, and consequently of the paper sheets or track upon their rolling off from the surface of the cylinder, thus also insuring a definite separation of the water spouting from the cylinder from the paper sheet or track itself in a direction away from the cylinder.

It is also very advantageous according to the invention if the outer band and the inner mesh roll off separately from the sealing strip. The roll-off of the paper sheet or track from the cylinder and its separation from the mesh is thus performed by a single rerouting means. It is also very advantageous, according to the invention, if the outer band is made of a largely water-resistant or waterproof material and if the paper sheet or track follows the band at the separation point thereof from the mesh. The density of the outer band is so large, that either very little or no water penetrates therethrough.

Consequently, water discharge is continuously effective on one side only, as is the case for a paper making machine using a longitudinal mesh. Contrary to a machine using a longitudinal mesh, the machine according to the present invention, avoids any pulsations whatever, so that water discharge or removal can be accomplished in a completely continuous manner. Additionally, a boundary layer between the suspended matter and air is avoided. Due to the successively disposed chambers supplied with respectively increasing pressure a gradual increase of the water discharge pressure is possible within the entire water discharge region, which is at least a first approximation to ideal water discharge conditions of equal water removal amounts per unit lengths of respective water-removal zones. A paper sheet or track manufactured by machines of this type has an approximately equal structure or texture over the thickness of the sheet or track. Sheets or tracks manufactured, however, in practice by band-pressure filter machines, which also employ a largely water-resistant or waterproof band, have a very dense texture on the side of the mesh, while sheets or tracks produced by machines employing a longitudinal mesh have, as a result of the pulsating water-removal means, a mesh side denuded of small particles.

According to the invention, it is also possible that the inner mesh is formed as a mesh-coating of the cylinder. This can be accomplished by the use of either an external mesh or by the employment of a largely water-resistant or waterproof outer mesh.

If a water-impenetrable outer band is used, it is proposed in a further development of the invention, that air-closure means be provided disposed between a nozzle used for injection of the stream carrying suspended matter and the outer band.

This prevents the entry or admixture of air between the suspended matter and the waterproof or water-impenetrable band. Any otherwise entering air could not escape through the band either, and could therefore lead to air occlusions damaging the paper sheet or track. If a largely water resistant or waterproof band is used, it will guide the paper sheet or track at, and from the separation point on, and according to a further development of the invention, will also guide the paper sheet or track immediately upon passing a water removal zone through a compression slot post-coupled thereto.

It is particularly advantageous if, according to the invention, drums supported in the last chamber and rotatable in the direction of rotation are provided to serve as sealing strips which are urgeable or can be pressed against the outer band.

It is a further advantage of the invention that the separation walls of the chambers and the outer mesh are separated by respective gaps for at least some of these chambers. This distance amounts to about 2 millimeters for the first separation walls as seen in the direction of rotation, and diminishes toward the last separation walls, having there a value in the range of 0.5 to 1 millimeters.

According to an advantageous development of version of the invention, a set of cylinders successively disposed behind each other as seen in the direction of rotation of the cylinder, is supplied with a single pressure supply means, which opens into the last chamber as viewed in the direction of rotation of the cylinder. As a result of the finite distance or gap between the separation walls and the outer band the compressed air from the last chamber of the set is therefore enabled to flow to the remaining chambers of the set in a direction opposite to the direction of rotation of the cylinder. This permits supply of compressed air not only to those chambers, but as a result of the use of an outer mesh the water forced therethrough together with the overflowing air is rerouted from these chambers into chambers lying ahead thereof. The first chamber of the set is provided with water discharge means, which serves for the discharge of all the water forced through the outer band within the region of this set.

This first chamber encompasses, according to the invention, a relatively large region of the surrounded cylinder segment.

As a result of the overflow of compressed air from one chamber to another the water adhering to the outer mesh in the form of a film is additionally separated within the region of the separation walls from the outer mesh, so that additional water is removed as a result of this overflow.

Other features which are considered as characteristic for the invention are set forth in the appended claims.

Although the invention is illustrated and described herein as embodied in a paper-making machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which.

Figure 1:
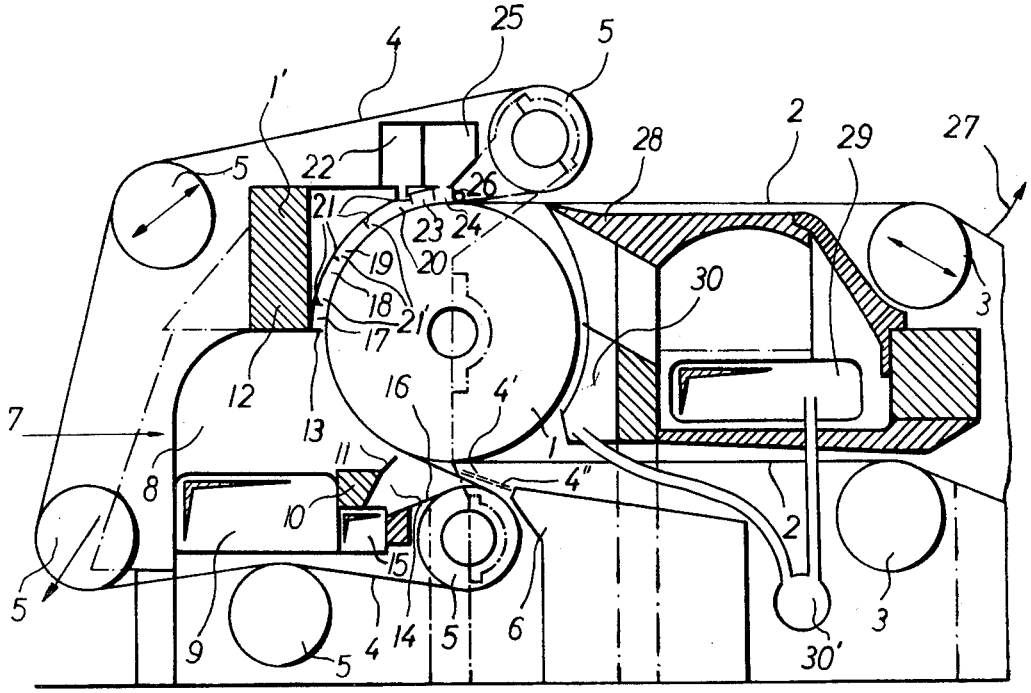
FIG. 1 is a partial section in elevation of a wet portion of a paper-making machine two meshes guided over a cylinder and an outer compression box.

FIG. 1 shows a rotatably supported cylinder 1 having a surface which is porous or formed with openings, the cylinder being disposed within an endless mesh 2, which is in contact with approximately one-half of the periphery thereof and guided by drums 3. The tension of the mesh 2 is adjusted by readjustment of one or several of the drums 3. The mesh 2 is covered by another mesh or outer band 4, within the region of the cylinder 1 which is also endless and is guided and held in tension by guide drums 5. Both meshes or bands 2 and 4 converge on the lower side of the cylinder 1 at an acute angle and form an inlet gap or aperture 4' for a jet of suspended matter ejected from a nozzle 6. On the outer side of the cylinder 1 there is disposed a pressure box 7 in the contact region of bands 2 and 4 with the cylinder, the paper sheet or track being formed between the two bands being subject to the exertion of pressure therefrom which is higher than the pressure within the interior of the cylinder 1. The pressure box 7 is formed with a chamber 8 which is provided with a discharge channel 9 for water squeezed from the paper sheet or track. The chamber 8 extends over a large region of the pressure box and is bounded on one hand by a wall 10 and a sealing strip 11 attached thereto and on the other hand by a carrier 12 having a sealing strip 13. The carrier 12 extends over the whole width of the machine and carries the whole pressure box. In the direction of rotation of the cylinder 1 and disposed ahead of the chamber 8 there is located a chamber 14 serving to receive water, which has penetrated the outer band 4 within the region of the gap between the two bands. The chamber 14 is also provided with a discharge channel 15 for the water, and is bounded on one hand by the wall 10 having a sealing strip 11 and on the other hand by a drum-scraper 16, which is in contact with the guide drum 5 of the outer mesh 4 associated with the nozzle 6. Round the rotating cylinder 1 and behind the chamber 8 there are disposed a plurality of chambers 17, 18, 19 and 20 which are separated from each other by respective sealing strips 21. A pressure-supply chamber 22 is connected to the last chamber 20 of these aforesaid chambers. Behind the chamber 20, and as seem in the direction of rotation of the cylinder 1 there are disposed two additional chambers 23 and 24, the latter being connected to an additional pressure-supply chamber 25. Between the chambers 20 and 23 on one hand, and the chambers 23 and 24 on the other hand there are disposed respective sealing strips 21. These sealing strips 21 are spaced at respective small distances from the outer mesh or band 4, as are the sealing strips 11 and 13, forming respective gaps 21' therebetween. As a result of these sealing strips the pressurized air flows in streams in a direction opposite to the direction of rotation of the cylinder 1 from one chamber to the next, displaces any water adhering to the band 4 and transports it to the next chamber.

The pressure prevailing in the individual chambers progresses thereofre from chamber to chamber, so that the highest pressure prevails in the last chamber as seen in the direction of rotation. A higher pressure prevails furthermore in the pressure supply chamber 25 than in the pressure supply chamber 22, so than an increasing pressure as seen in the direction of rotation is ensured also for the last chambers. The end wall 26 of the chamber 24 is directly in contact with the outer mesh 4, so that the pressurized air cannot escape in that direction. Both bands or meshes extend around this end wall 26 in only a small degree, so that both bands can roll off, or become detached from the cylinder 1. Both bands or meshes 2 and 4 run off separately from the end wall 26, the just formed manufactured paper sheet or track 27 adhering to the band or mesh 2 immediately in contact with the cylinder, and being detached therefrom at a location remote from the cylinder 1.

Following the roll-off point of the mesh or band 2 from the cylinder 1, there is disposed on the lower side of the mesh or band a deflector 28, which guides the water which has been contained and poured into the openings of the cylinder 1 and is spurting tangentially therefrom, to a discharge channel 29. A collection channel 30 follows this discharge channel 29 as seen in the direction of rotation of the cylinder for collecting any additional water flowing from the opening of the cylinder 1.

Both channels 29 and 30 are connected to a vacuum 30', so that the segment of the cylinder covered by the bands, and hence the whole or entire inner space of the cylinder is subjected to a vacuum.

In this case sealing strips are required which seal both meshes or bands ahead of the impact region of the jet of suspended matter to prevent deflection thereof toward the inner mesh or band.

Figure 2:
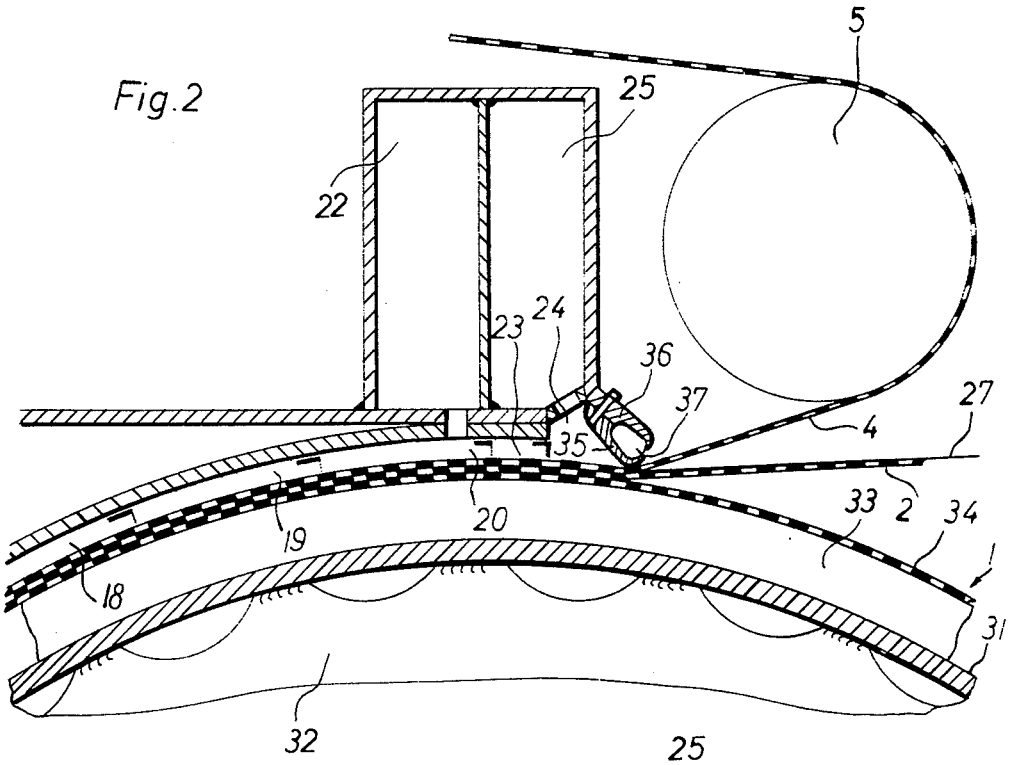
FIG. 2 shows an elevational section of the cylinder in part section including the end part of the pressure box, whose end wall is provided with a resiliently yieldable sealing strip pressuring against the meshes according to FIG. 1.

The cylinder 1 illustrated in FIG. 2 consists substantially of a tube 31, made rigid by discs 32 disposed at right angles to the axis thereof. On the outer surfaces of the tube 31 there are disposed on its periphery ribs 33, a coarse mesh covering 34 being in contact therewith. A sealing strip comprising a yieldably elastic scraper blade 35 screwed onto a holder 36 is disposed on an end wall of the chamber 24 in the version illustrated in FIG. 2. Between the scraper blade 35 and the holder 36 there is clamped a pressure hose 37, which is fed by the same pressure source as is the pressure supply chamber 25. This ensures a secure sealing of the chamber 24 under any prevailing pressures in the aforesaid direction of rotation.

Both bands 2 and 4 surround the scraper blade 35 only in a small measure so that they are free to roll off from the cylinder 1. The respective radii of curvature of the two bands within their region of contact with the scraper blade 35 are relatively small and less than 10 centimeters. In a preferred version that radius lies within the region of 2 to 5 centimeters. This results in a pronounced or positive deflection of the two meshes or bands, and ensures in turn a secure separation or displacement of the water spurting tangentially from the cylinder from the paper sheet or paper track itself. Both meshes or bands roll off separately from the scraper blade 35, the paper sheet or track 27 being in contact with the band 2 upon roll off.

Figure 3:
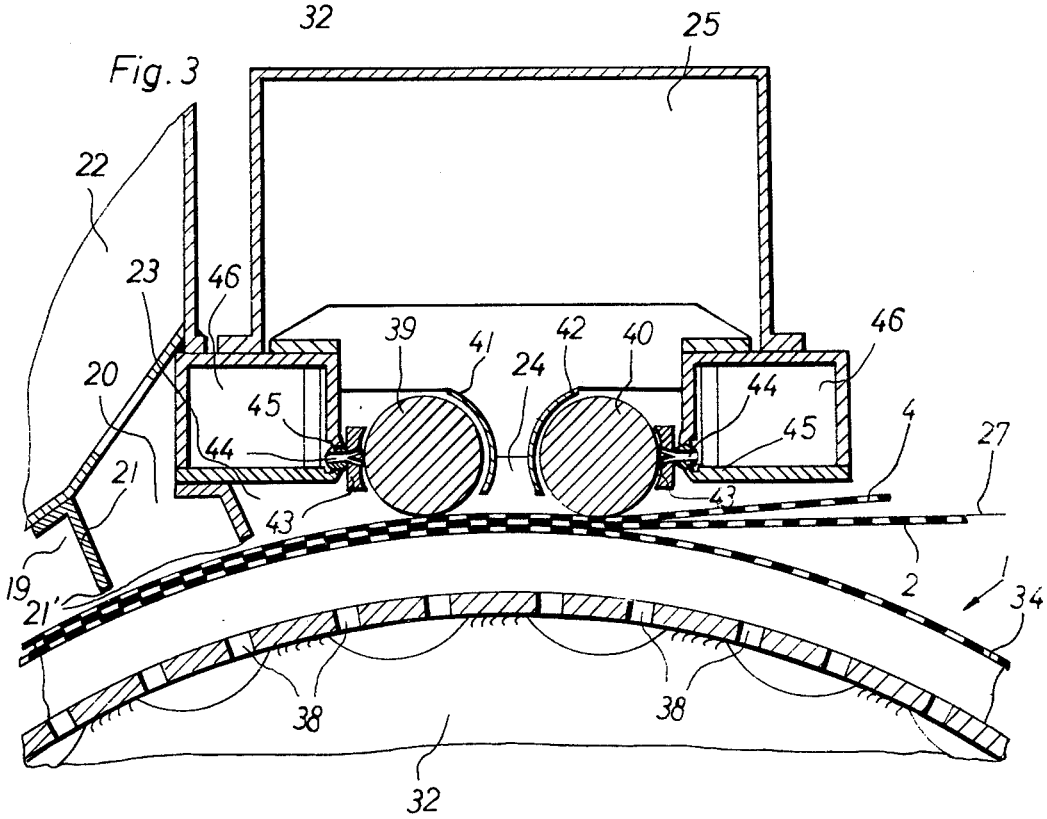
FIG. 3 is an elevational partial cross section of another version of the invention showing the sealing of the last chambers of the compression box using two meshes according to FIG. 1.

In the version shown in FIG. 3 the tube 31 forming the cylinder is formed with bores or openings 38, through which the air forced thereinto by the paper sheet or paper track can escape into the interior of the cylinder.

In this version of the invention the last chamber in the direction of rotation is sealed off by two rotating drums 39 and 40, each of the drums in turn also having a maximum radius of about 10 centimeters. These two drums are also supported in respective cup-shaped holders 41 and 42 in which they are held during a change of the bands. Both drums 39 and 40 are pressed by the pressurized air from the pressure supply chamber 25 against both the outer band and a pivotably supported hydrostatic shoe 43.

The hydrostatic shoe 43 is held under pressure supplied via a bore 44 formed in a joint 45 through pressure means, the pressure being supplied thereto through a chambr 46.

The paper sheet or paper track always follows or adheres to the band immediately or directly making contact with the cylinder following the roll-off point of the two bands from the cylinder in the example shown. The paper sheet or track could, however, be made to follow or adhere to the outer of the two bands following the roll-off point thereof from the cylinder.

In a fashion not further illustrated it is also possible to let both bands or meshes roll off jointly from the drum, and to separate then in a known fashion only later subsequently, within the vacuum region of a suction drum or suction box.

Figure 4:
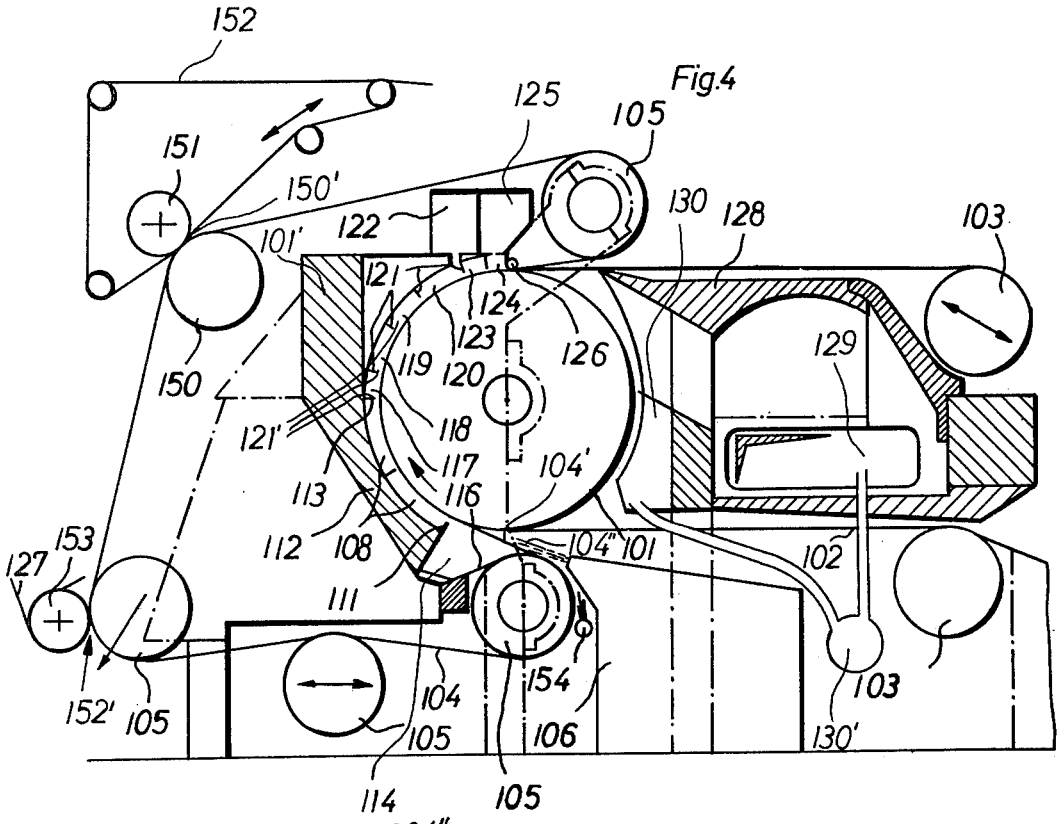
FIG. 4 is a partial elevational cross section through a wet portion of another version of the paper making machine having an outer band which is largely water proof.

In the version shown in FIG. 4, a cylinder 101 has a surface formed with bores and is rotatably supported in a manner similar to that of the cylinder 1 shown in FIG. 1. The cylinder 101 is disposed within an endless mesh or band 102, which adheres to approximately one-half of its periphery and is guided by guide drums 103. The tension in the mesh or band 102 is adjusted by readjustment of one or several of the guide drums 103. Within the contact region of the mesh 102 with the cylinder 101 the latter is covered by a largely water-resistant band 104, which is also endless and is guided by guide drums 105 and 150 and held under tension thereby. On the lower or underside of cylinder 101, the outer band 104 and the mesh 102 coverage at an acute angle, and form an inlet gap or aperture 104' for a jet 104'' of suspended matter ejected or emanating from a nozzle 106. On the outer side of the cylinder 101 there is disposed a plurality of pressure chambers 108, 117, 118, 119, 120, 123 and 124 through which pressure can be applied to the paper sheet or track 127 being formed between the band 104 and the mesh 102, that pressure being higher than the pressure prevailing in the interior of the cylinder. Chambers successively disposed behind each other in the direction of rotation of the cylinder 101 are separated from each other by respective sealing strips 111, 113 and 121. A pressure supply chamber 122 is attached to the chamber 120. Additional chambers 123 and 124 are disposed behind the chamber 120 in the direction of the rotation of the cylinder 101, the chamber 124 being connected to an additional supply-chamber 125. Between the chambers 120 and 123 on one hand, and the chambers 123 and 124 on the other hand respective additional sealing strips 121 are disposed. The sealing strips 121 are separated by respective gaps 121' from the outer band 104, as are sealing strips 111 and 113. The sealing strips 121 ensure that the pressurized air is transported from one chamber to the other in a direction opposite to the direction of rotation of the cylinder, possibly peeling off any water adhering to the band 104 and transporting it to the next chamber. The pressure in the individual chambers thereby progresses from chamber to chamber so that the highest pressure prevails in the last chamber as seen in the direction of rotation of the cylinder 101. Furthermore, in the pressure supply chamber 125 there exists a higher pressure than in the pressure supply chamber 122, so that a pressure increasing in the direction of rotation of the cylinder 101 is ensured also for the last chamber. The end wall 126 of the chamber 124 is directly in contact with the outer band 104 so that no pressurized air can escape on that side. The band and the mesh surround the end wall 126 in only a small measure so that both can roll off from the cylinder 101. The band 104 and the mesh 102 roll off separately from the end wall 126, so that the fully formed paper sheet or track 127 rolls off with the band 104 and is removed therefrom at a location distant from that of the cylinder 101.

The band 104 arrives together with the paper sheet or track 127 at a press location 150' disposed between two pressure drums 150 and 151, an additional felt band 152 passing therethrough.

At a second compression location 152' the paper sheet or track 127 is pressed between the band 104 and an outer drum 153 having a smooth surface, which due to the latter's greater adhering capability lifts the paper sheet or track 127 from the band 104 and continues to guide it therefrom.

Additionally, a spray gun or tube 154 is provided close to the inlet gap 104' disposed between the nozzled 106 and the drum 105, which fills the gap with water substantially over the width of the machine so that air cannot form on the lower side of the jet of suspended matter.

Behind the roll-off point of the mesh 102 from the cylinder 101 there is disposed at the lower side of the mesh a deflector 128, which guides the water contained and pressed into the bores of the cylinder 101, and tangentially spurting therefrom into a discharge channel 129 at the roll-off point. A collector channel 130 follows the discharge channel 129 in the direction of rotation of the cylinder for collecting any additional water passing through the opening or bores of the cylinder 101.

Both channels 129 and 130 are connected to a vacuum source 130', so that the segment of the cylinder not covered by the bands and hence the whole interior of the cylinder is subjected to suction.

In such a case sealing strips are required which seal off the outer band and the mesh ahead of the impact region of the jet of suspended matter, so that any deflection of the jet and the outer band towards the inner mesh is prevented.

Figure 6:
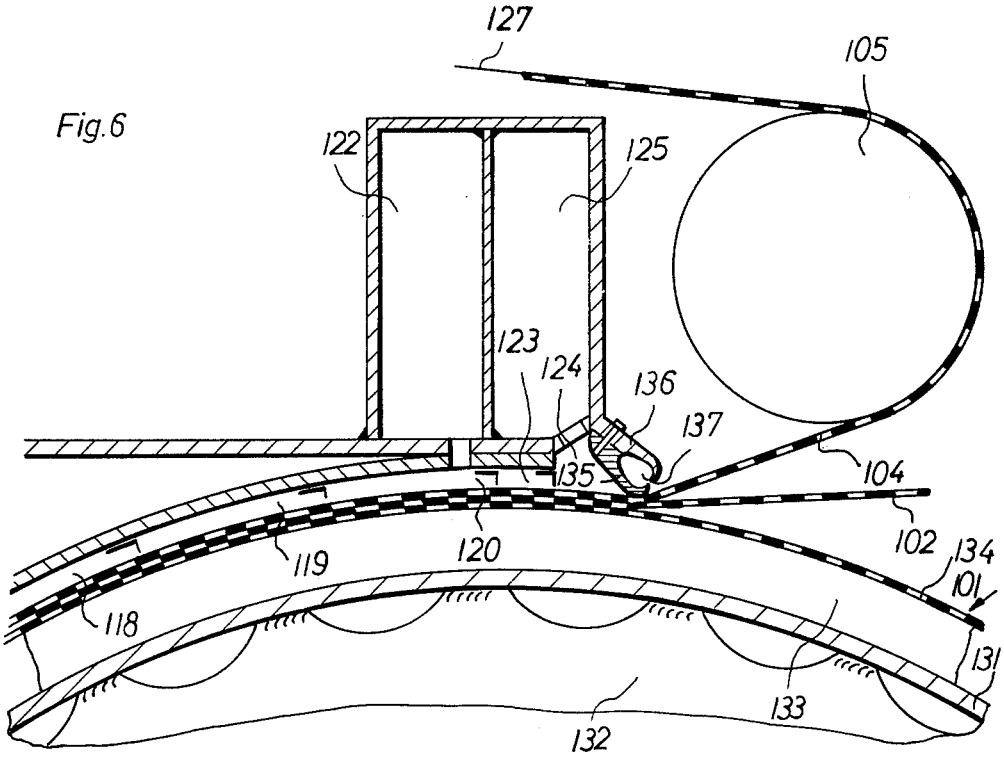
FIGS. 6 and 7 show respective elevational views in partial section for the sealing means according to FIGS. 2 and 3 when using a largely water-resistant outer band.

The cylinder 101 illustrated in FIG. 6 comprises, as does the version illustrated in FIG. 2, essentially a tube 131, which is made rigid by discs 132 disposed at right angles thereto. On the outer surface of the tube 131 there are disposed ribs 133 along its periphery, a coarse mesh coat 134 resting thereon.

A sealing strip is disposed in this version of the invention on the end wall of the chamber 124 and is formed in the shape of a yieldably elastic scraper blade 135 which is screwed onto a holder 136. A pressure hose 137 is clamped in between the scraper blade 135 and the holder 136, the hose being connected to the same pressure source as the pressure supply chamber 125. This ensures a secure sealing off of the chamber 124 in that direction during any pressures prevailing therein.

The mesh 102 and the band 104 surround the scraper blade 135 in only a small measure so that they both can roll off from the cylinder 101. The respective radii of curvature of the mesh and the band in the region of contact with the scraper blade 135 are relatively small and amount to less than 10 centimeters; in a preferred version that radius lies within a region of 2 to 5 centimeters. The mesh and the band are therefore positively rerouted, which ensures a secure separation of the water spurting off from the cylinder from the paper sheet or track itself. The band and the mesh roll off separately from the scraper blade 135, the paper sheet or track 127 adhering upon roll off therefrom to the band 104.

Figure 7:
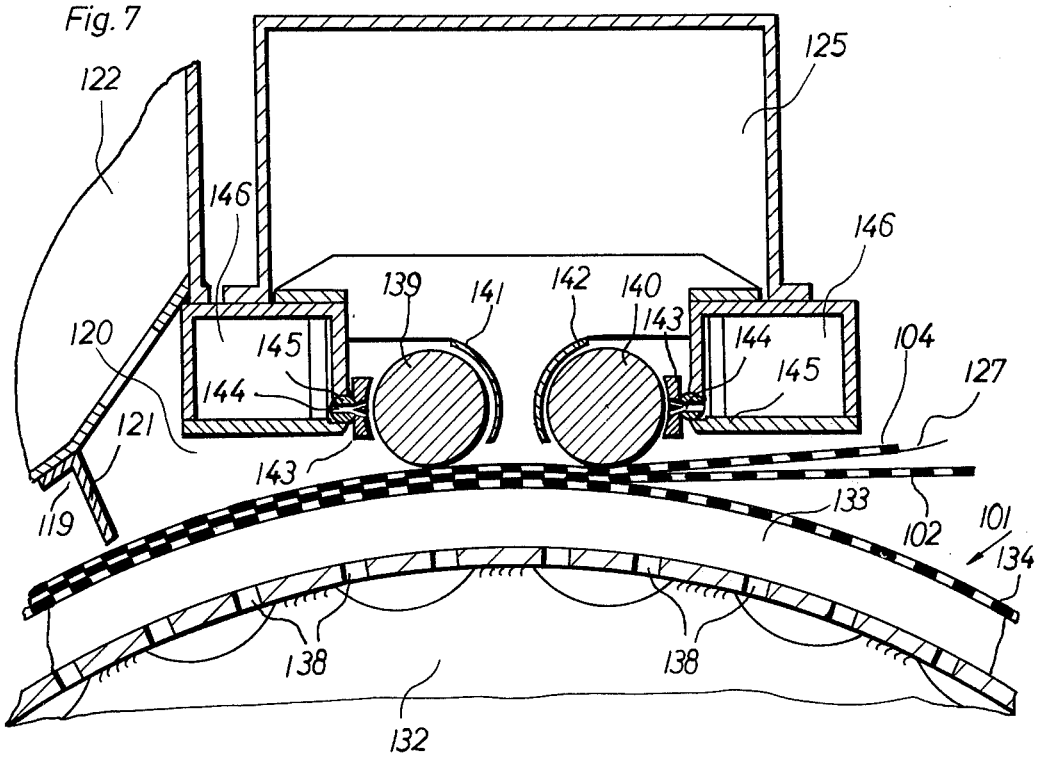

In the version shown in FIG. 7 a tube 131 forming the cylinder is formed with bores 138, through which the air displaced by the water can escape into the cylinder.

In this version the last chamber, as seen in the direction of rotation of the cylinder 101, is sealed off by two rotating drums 139 and 140, the radius of each of which is also maximally 10 centimeters. These two drums are supported in respective cup-shaped holders 141 and 142, in which they are respectively held during any change of the band. Both drums 139 and 140 are pressed against the outer band and against a pivotally supported hydrostatic shoe 143 by means of the compressed air from the pressure supply chamber. The hydrostatic shoe 143 is held under pressure by pressure means supplied through a chamber 146 via a bore 144 which is formed in a joint 145.

Figure 8:
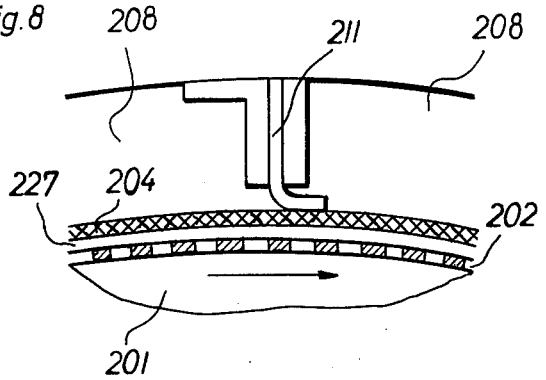
FIG. 8 is a partial elevational-section showing sealing strips disposed between the individual chambers.
Figure 5:
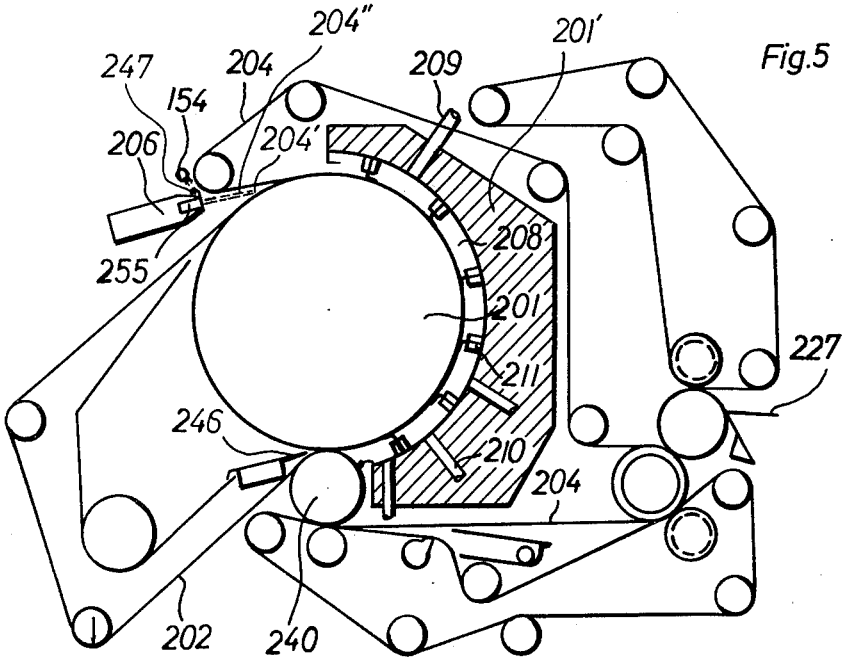
FIG. 5 is another version of a paper-making machine according to the invention in partial elevational cross-section having a largely water resistant band.

FIG. 5 shows a different version of a machine operating along similar principles together with a dewatering or water removal disposition. Each of several pressure chambers 208 is provided with an air pressure connection 209 and a de-aerator or water-discharge connection 210. Sealing strips 211 are disposed between respective individual pressure chambers 208 and are shown enlarged in FIG. 8. The sealing strip 211 proper is made of an elastic material and is sealingly in contact with the outer band 204, the end part of the sealing strip 211 facing the band 204 being thereby in the direction of rotation of the cylinder 201. At the roll-off point, the outer band 204 and the inner mesh 202 surround a drum 240 in this particular example, as shown in FIG. 5. On the free side of the mesh 202 there is disposed at the roll-off point from the cylinder 201 along the continuation of its tangent a scraper 246, which drains off the water flowing from the mesh during the re-routing thereof.

The pressure increases, for example, in a geometric progression from chamber to chamber, with a factor of approximately 1.5, starting with a water pressure of 20 centimeters in the first chamber and ending with a water pressure of 12 meters in the last chamber.

If a largely water-resistant water band 104 or 204 is used, it is advisable to dispose water nozzles 255 next to the nozzles 106 or 206 respectively, for example laterally, as illustrated in FIG. 5, only one nozzle 255 being shown in that figure. Both resulting water jets border the jet of suspended matter and prevent any lateral ejection of the pulp-like suspended matter between on one hand, the band 104 or 204, and on the other hand, the mesh 102 or 202.

I claim:

1. A paper making machine comprising: a hollow cylinder rotatable in a predetermined direction and having a porous surface; an inner mesh band wrapped around a portion of said cylinder; means guiding said inner mesh band into and out of contact with said cylinder; an outer band wrapped around said inner mesh band and partially surrounding said cylinder; means guiding said outer band into and out of contact with said inner mesh band, said inner and outer bands converging to form an inlet aperture therebetween; a nozzle for spraying suspended matter into said aperture between said bands; and a housing formed with a plurality of chambers disposed and open on a side facing said cylinder surrounded by said outer band, means providing successive chambers in the direction of operative rotation of said cylinder with increasing air pressure, the entire inner surface of said cylinder being subjected to a uniform pressure smaller than the pressure exerted on the part thereof surrounded by said outer band.

2. A paper making machine according to claim 1 wherein said porous surface of said cylinder is formed by a peripheral mesh covering.

3. A paper-making machine according to claim 1 further comprising a single pressure supply-means for furnishing pressure to a set of said chambers disposed successively behind each other as viewed in the direction of said operative rotation of said cylinder, the last chamber of said set of chambers receiving said pressure supply-means.

4. A paper-making machine according to claim 3 further comprising a discharge channel for the first of said chambers as seen in said direction of operative rotation of said cylinder, said first chamber extending over and surrounding a relatively large region of a segment of said cylinder.

5. A paper making machine according to claim 4 further comprising: a wall adjacent the last of said chambers; and sealing means engaging said wall for substantially closing off at least the last of said chambers; said outer band separating from said cylinder at a roll off point.

6. A paper-making machine according to claim 5 wherein said sealing means closes off the last two chambers and includes at least one rotatably supported drum urgeable against said outer hand.

7. A paper-making machine according to claim 6 wherein said wall comprises a hydrostatic shoe abutting, and disposed in parallel with the surface of said drum.

8. A paper-making machine according to claim 5 wherein said sealing means has a radius of curvature ajacent said outer band not exceeding 10 centimeters.

9. A paper-making machine according to claim 8 wherein said radius of curvature is within the range of 2 to 5 centimeters.

10. A paper-making machine according to claim 5 wherein at least some of said chambers have respective separation walls, said walls being separated from said outer band by respective gaps.

11. A paper making machine according to claim 5 wherein said guide means operatively separate said outer band and said inner mesh band from each other upon passing said sealing means.

12. A paper-making machine according to claim 11 further including yieldably resilient means urging said sealing means into contact with said outer band.

13. A paper-making machine according to claim 11 wherein said outer band is made of substantially liquid-resistant material and wherein said suspended matter is pulp-like and operatively formed into a paper-like sheet in contact with and following said outer band upon the separation thereof from said inner mesh band.

14. A paper-making machine according to claim 13 wherein said outer band is a felt-track.

15. A paper-making machine according to claim 16 wherein said felt-track has a water-resistant coating.

16. A paper-making machine according to claim 13 further comprising air-entry closure-means disposed between said nozzle and said outer band for substantially preventing the passage of air there between.

17. A paper-making machine according to claim 16 wherein said aperture formed between said inner and outer bands is substantially filled with a jet of said suspended matter and wherein said air-entry closure means is a liquid-supply means extending over the width of said machine for enriching said jet of said suspended matter operatively ejected from said nozzle with a liquid.

18. A paper making machine according to claim 17 further comprising liquid-removal means disposed behind said roll off point for operatively removing liquid from said paper-like sheet and pressure-applying means disposed behind said liquid removal means for operatively compressing said paper-like sheet following liquid-removal therefrom.

19. A paper-making machine according to claim 18 further comprising a liquid-ejecting nozzle disposed on one side of the nozzle operatively ejecting said jet suspended matter.

20. A paper-making machine according to claim 17 further comprising a scraper disposed on the inner side of, and operatively removing liquid from said inner mesh directly surrounding said cylinder in the direction of rotation thereof and following operative roll-off of said inner mesh therefrom.

* * * * *